US007444908B2

(12) United States Patent
Lin

(10) Patent No.: US 7,444,908 B2
(45) Date of Patent: Nov. 4, 2008

(54) TOOL HANDLE DRIVABLE BY OTHER TOOL

(76) Inventor: Hsiu Nien Lin, No. 7, Lane 256, Lijen Road, Dali City, Taichung Hsien 41247 (TW)

( * ) Notice: Subject to any disclaimer, the term of this patent is extended or adjusted under 35 U.S.C. 154(b) by 0 days.

(21) Appl. No.: 11/729,245

(22) Filed: Mar. 27, 2007

(65) Prior Publication Data

US 2008/0060489 A1 Mar. 13, 2008

(30) Foreign Application Priority Data

Sep. 12, 2006 (TW) ..... 95216232 U

(51) Int. Cl.
*B25B 23/16* (2006.01)
*B25G 1/04* (2006.01)
*B25G 3/02* (2006.01)

(52) U.S. Cl. ..... 81/438; 81/177.2

(58) Field of Classification Search ..... 81/438, 81/489, 177.1, 177.2
See application file for complete search history.

(56) References Cited

U.S. PATENT DOCUMENTS 1,888,222 A * 11/1932 Curtis et al. ..... 81/436
2,564,356 A * 8/1951 Dianda ..... 81/61
2,620,001 A * 12/1952 Fratz et al. ..... 81/177.1
3,508,455 A * 4/1970 Miller ..... 81/58.1
3,575,069 A * 4/1971 White ..... 81/58.1
4,212,336 A * 7/1980 Smith ..... 81/436
4,350,064 A * 9/1982 Markle ..... 81/437
4,541,314 A * 9/1985 Korkowski ..... 81/58.1
4,739,536 A 4/1988 Bandera et al. ..... 16/111 R
4,776,246 A 10/1988 Elliston ..... 81/439
4,858,504 A * 8/1989 Tsai ..... 81/436
5,911,798 A * 6/1999 Arnold ..... 81/177.2
6,089,133 A * 7/2000 Liao ..... 81/438
6,588,994 B2 * 7/2003 Wienhold ..... 408/226
6,655,240 B1 * 12/2003 DeVecchis et al. ..... 81/438
6,976,411 B1 * 12/2005 Yu ..... 81/177.2
2005/0274232 A1 * 12/2005 Wu ..... 81/177.1
2007/0214916 A1 * 9/2007 Lee ..... 81/177.1

* cited by examiner

*Primary Examiner*—David B Thomas
(74) *Attorney, Agent, or Firm*—Charles E. Baxley

(57) ABSTRACT

A tool handle device includes a hand grip member having a bore formed through the hand grip member for receiving a shaft, the shaft has an orifice formed in one end for detachably engaging with a tool member and for rotating or driving the tool member, the shaft further includes an engaging hole formed in the other end portion for engaging with a driving tool and for allowing the shaft of the hand grip member to be selectively rotated and driven by the driving tool, the shaft may include a noncircular segment extended out of the hand grip member for being driven by the driving device. The shaft has a noncircular cavity for engaging with a noncircular connector of the tool member.

1 Claim, 4 Drawing Sheets

TOOL HANDLE DRIVABLE BY OTHER TOOL

BACKGROUND OF THE INVENTION

1. Field of the Invention

The present invention relates to a tool handle, and more particularly to a tool handle for coupling to various tool members and for driving the tool members and capable of being rotated or driven by the other driving tools.

2. Description of the Prior Art

Typical tool handles comprise a hand grip body or member, and a blade or tool stem or tool shank solidly secured to the hand grip member or extended from the hand grip member for coupling to various tool members and for driving the tool members.

For example, U.S. Pat. No. 4,739,536 to Bandera et al. discloses one of the typical screwdriver handgrips also comprising a blade solidly secured to the hand grip member for coupling to various tool members and for driving the tool members.

However, the hand grip member may only be used to rotate or to drive or to operate the blade, but may not be rotated or driven by the other driving tools.

U.S. Pat. No. 4,776,246 to Elliston discloses another typical screwdriver hand tool comprising a hand grip body or member having a channel formed therein for detachably or changeably receiving a tool member and for allowing the tool member to be removed or disengaged from the hand grip member and to be changed to different tool members or the like.

However, similarly, the hand grip member may only be used to rotate or to drive or to operate the tool member, but may not be rotated or driven by the other driving tools.

The present invention has arisen to mitigate and/or obviate the afore-described disadvantages of the conventional hand grip members for tools.

SUMMARY OF THE INVENTION

The primary objective of the present invention is to provide a tool handle for coupling to various tool members and for driving the tool members and capable of being rotated or driven by the other driving tools.

In accordance with one aspect of the invention, there is provided a tool handle device comprising a hand grip member including a longitudinal bore formed therein and formed through the hand grip member, and including a first end portion and a second end portion, a shaft engaged in the longitudinal bore of the hand grip member, the shaft including a first end portion engaged in the second end portion of the hand grip member, and including a second end portion engaged in the first end portion of the hand grip member, the shaft including an orifice formed in the second end portion of the shaft, and a tool member including a tool shank detachably engaging into the orifice of the shaft for being rotated and driven by the shaft, and the shaft includes an engaging hole formed in the first end portion of the shaft for engaging with a driving tool and for allowing the shaft of the hand grip member to be selectively rotated and driven by the driving tool.

The shaft includes a knurled surface forming in an outer peripheral portion thereof for engaging with the hand grip member and for solidly securing to the hand grip member. The tool member includes a tool coupler provided thereon.

The hand grip member includes an enlarged compartment formed in the second end portion of the hand grip member and communicating with the longitudinal bore of the hand grip member, the compartment of the hand grip member includes an inner diameter greater than that of the longitudinal bore of the hand grip member, the shaft includes an enlarged head formed in the first end portion of the shaft and having an outer diameter greater than that of the shaft for engaging with the enlarged compartment of the hand grip member and for solidly anchoring the shaft to the hand grip member.

The hand grip member includes an inner peripheral shoulder formed within the longitudinal bore of the hand grip member and located between the longitudinal bore and the compartment of the hand grip member, and the shaft includes an outer peripheral shoulder formed between the shaft and the enlarged head for engaging with the inner peripheral shoulder of the hand grip member and for solidly anchoring the shaft to the hand grip member.

The shaft includes a noncircular segment provided on the first end portion of the shaft and extended out of the second end portion of the hand grip member for engaging with a driving device and for being driven by the driving device.

The shaft includes a noncircular cavity formed therein and communicating with the orifice of the shaft, and the tool member includes a noncircular connector for engaging with the cavity of the shaft and for allowing the tool member to be rotated and driven by the shaft of the hand grip member.

The shaft includes at least one depression formed therein and communicating with the cavity of the shaft, and the tool member includes a spring-biased projection engaged therein for engaging with the depression of the shaft and for detachably anchoring the tool member to the shaft.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
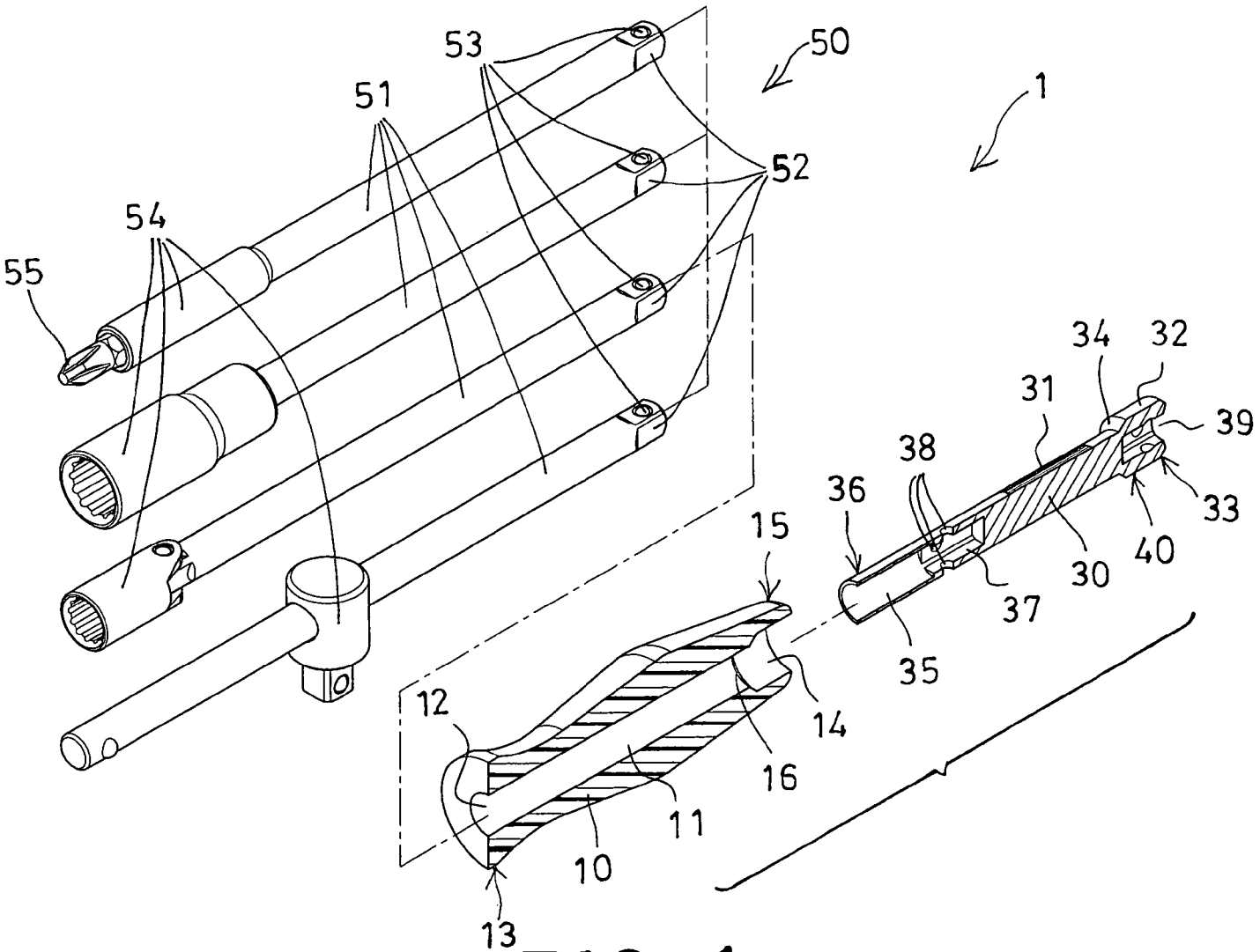
FIG. 1 is an exploded view of a tool handle in accordance with the present invention, in which a portion of the tool handle has been cut off for showing an inner structure of the tool handle.
Figure 3:
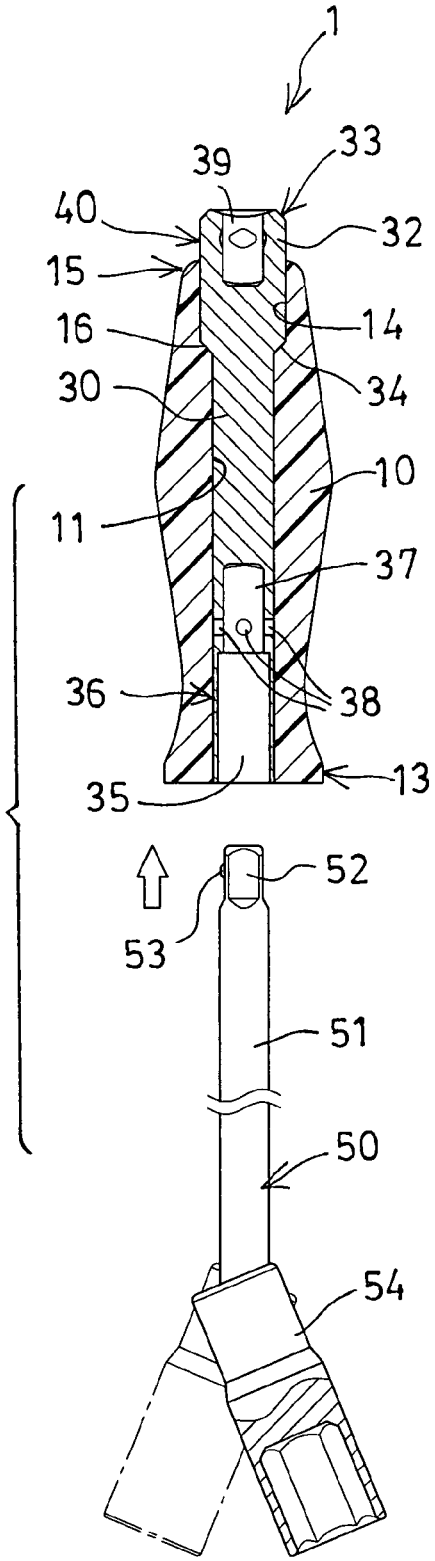
FIG. 3 is a partial exploded and partial cross sectional view of the tool handle taken along lines 3-3 of FIG. 2.
Figure 2:
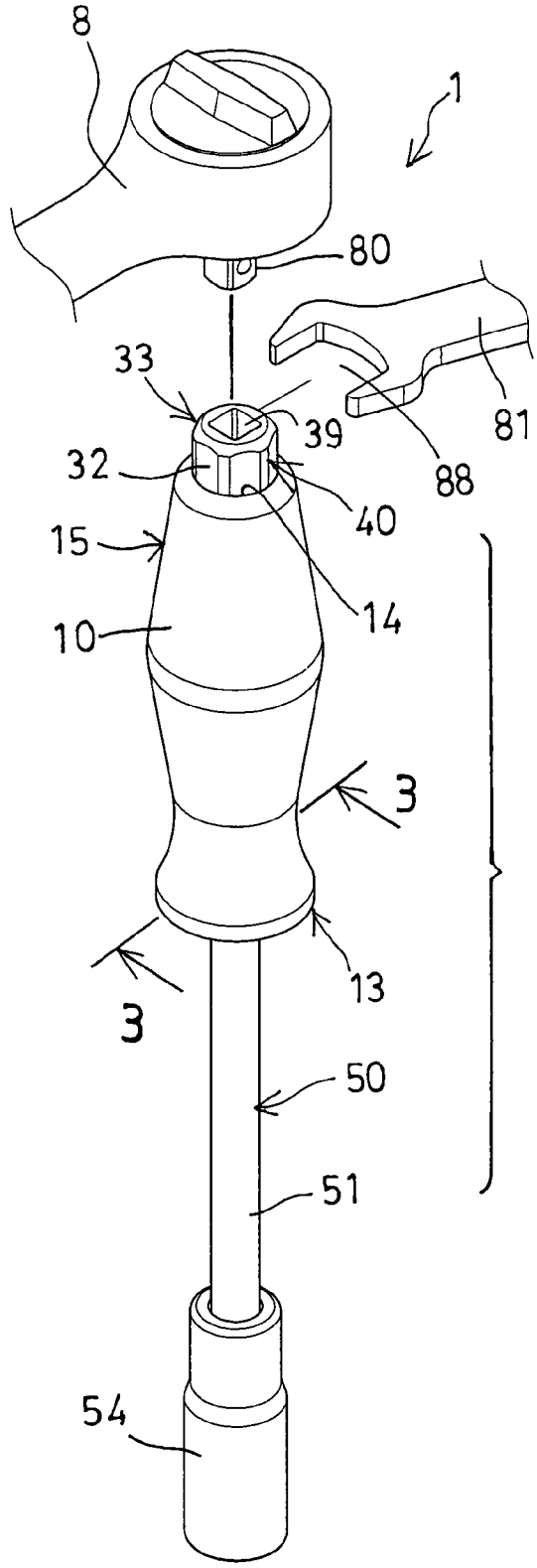
FIG. 2 is a partial exploded view of the tool handle illustrating the operation of the tool handle.

Referring to the drawings, and initially to FIGS. 1-3, a tool handle combination or device 1 in accordance with the present invention comprises a hand grip body or member 10 including a longitudinal bore 11 formed therein, and preferably formed through the length of the hand grip member 10, and including an opening 12 formed in one end portion 13 of the hand grip member 10, and including an enlarged compartment 14 formed in the other end portion 15 of the hand grip member 10 and communicating with the longitudinal bore 11 of the hand grip member 10, in which the compartment 14 of the hand grip member 10 includes an inner diameter greater than that of the longitudinal bore 11 of the hand grip member 10 for forming an inner peripheral shoulder 16 within the longitudinal bore 11 of the hand grip member 10 and between the longitudinal bore 11 and the compartment 14 of the hand grip member 10.

The tool handle device 1 further includes a longitudinal shaft 30 engaged within the longitudinal bore 11 of the hand grip member 10, and the shaft 30 includes a knurled or serrated surface 31 forming in the outer peripheral portion thereof for engaging with the hand grip member 10, and for solidly securing to the hand grip member 10 with such as a force-fitted engagement. The shaft 30 preferably, but not necessarily includes an enlarged head 32 formed in one end portion 33 of the shaft 30 and having an outer diameter greater than that of the shaft 30 for engaging in the compartment 14 or the other end portion 15 of the hand grip member 10 and for anchoring or securing the shaft 30 to the hand grip member 10, and includes an outer peripheral shoulder 34 formed between the shaft 30 and the enlarged head 32 for engaging with the inner peripheral shoulder 16 of the hand grip member 10 and for further solidly anchoring or securing the shaft 30 to the hand grip member 10.

The shaft 30 further includes an orifice 35 formed in the other end portion 36 of the shaft 30 which is engaged in the opening 12 or the one end portion 13 of the hand grip member 10 for engaging with or for receiving the tool shank 51 of various tool members 50, and further includes a cavity 37 formed therein, such as formed in the inner and middle portion thereof and communicating with the orifice 35 of the shaft 30 and having a noncircular cross section for engaging with the corresponding noncircular connector 52 of the tool members 50 that is formed or provided on one end of the tool members 50, and for allowing the tool members 50 to be detachably and selectively or changeably rotated or driven by the shaft 30 of the hand grip member 10. The shaft 30 further includes one or more depressions 38 formed therein and laterally formed through the shaft 30 (FIGS. 1, 3) and communicating with the orifice 35 or the cavity 37 of the shaft 30, and the tool members 50 each include a spring-biased detent or projection 53 engaged therein for engaging with either of the depressions 38 of the shaft 30, and for detachably anchoring or securing the tool members 50 to the shaft 30.

It is preferable that the tool members 50 each include a socket or tool coupler 54 formed or provided or coupled to the other end thereof for coupling to various fasteners or tool elements 55 (FIG. 1) and for driving the fasteners or tool elements 55. The shaft 30 further includes an engaging hole 39 formed in the one end portion 33 of the shaft 30 for engaging with or for receiving a driving stem 80 of a driving tool 8 (FIG. 2) and for allowing the shaft 30 of the hand grip member 10 to be selectively rotated or driven by the driving tool 8. The shaft 30 further includes a noncircular outer peripheral segment 40 formed or provided on the outer peripheral portion of the shaft 30 or the enlarged head 32 and extended out of the other end portion 15 of the hand grip member 10 for engaging with the engaging notch 88 of the other driving device 81 (FIG. 2) and for allowing the shaft 30 of the hand grip member 10 also to be selectively rotated or driven by the other driving device 81.

Figure 5:
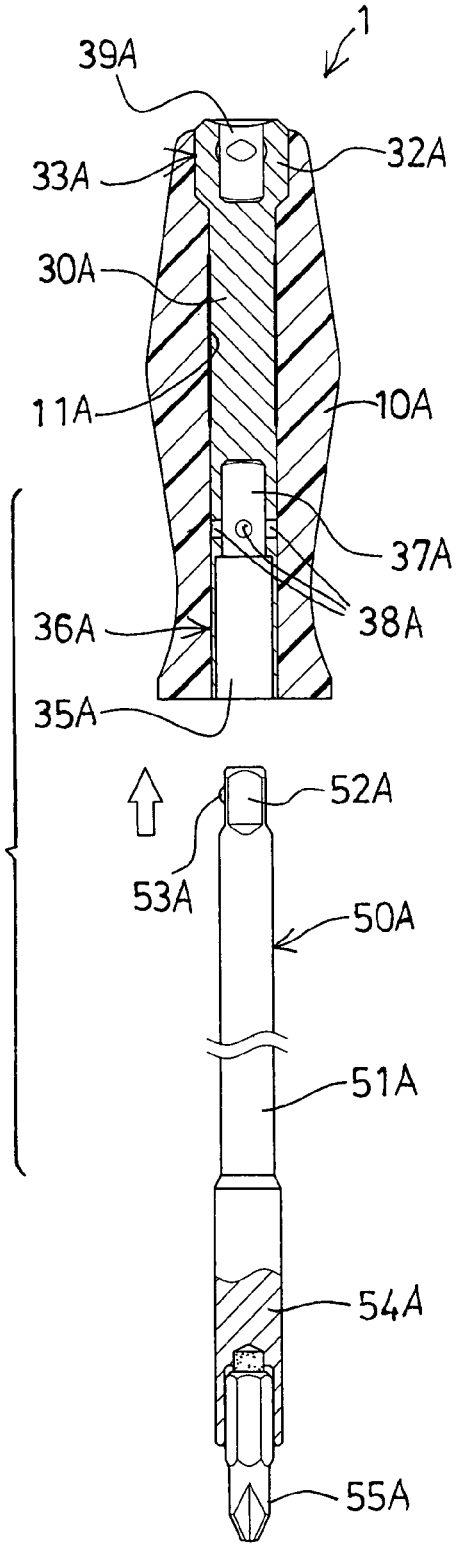
FIG. 5 is a partial exploded and partial cross sectional view of the tool handle as shown in FIG. 4.
Figure 4:
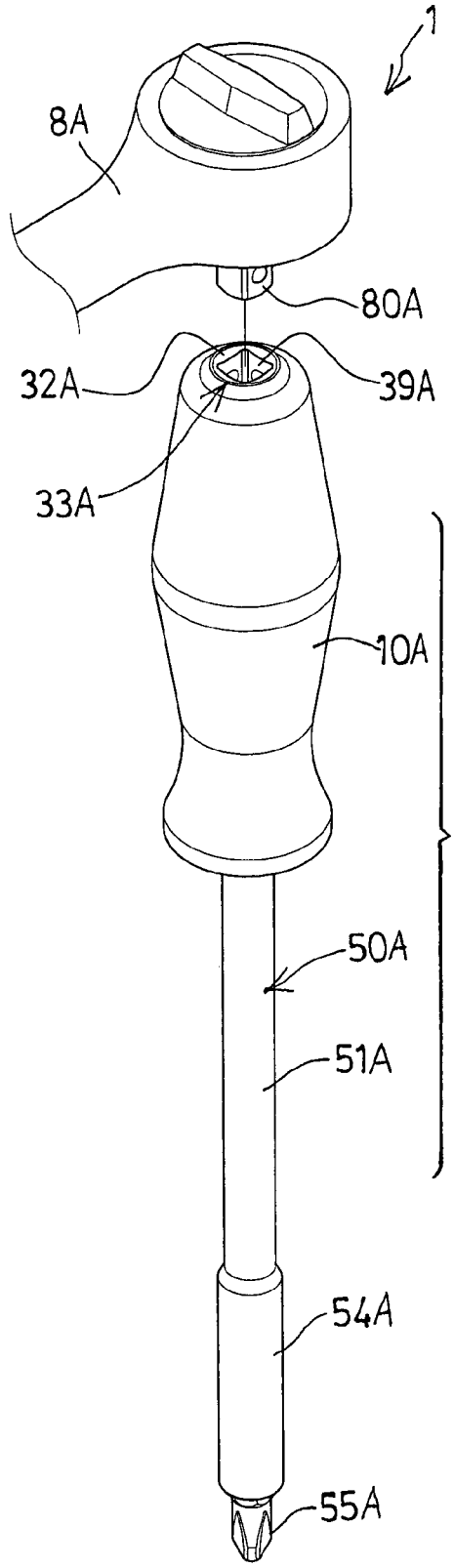
FIG. 4 is a partial exploded view similar to FIG. 2 illustrating the other arrangement of the tool handle.

Alternatively, as shown in FIGS. 4 and 5, the tool handle device 1 may also includes a longitudinal shaft 30A engaged within the longitudinal bore 11A of the hand grip member 10A, and the shaft 30A also includes an enlarged head 32A formed in one end portion 33A of the shaft 30A, and also includes an engaging hole 39A formed in the one end portion 33A of the shaft 30A for engaging with or for receiving a driving stem 80A of a driving tool 8A (FIG. 4) and for allowing the shaft 30A of the hand grip member 10A to be selectively rotated or driven by the driving tool 8A. The shaft 30A also includes an orifice 35A formed in the other end portion 36A of the shaft 30A for engaging with or for receiving the tool shank 51A of various tool members 50A, and further includes a noncircular cavity 37A formed therein and communicating with the orifice 35A of the shaft 30A for engaging with the noncircular connector 52A of the tool members 50A and for allowing the tool members 50A to be selectively or changeably rotated or driven by the shaft 30A of the hand grip member 10A.

The shaft 30A further includes one or more depressions 38A formed therein and communicating with the orifice 35A or the cavity 37A of the shaft 30A, and the tool members 50A each include a spring-biased detent or projection 53A engaged therein for engaging with either of the depressions 38A of the shaft 30A, and for detachably anchoring or securing the tool members 50A to the shaft 30A. It is also preferable that the tool members 50A each include a socket or tool coupler 54A formed or provided or coupled to the other end thereof for coupling to various fasteners or tool elements 55A and for driving the fasteners or tool elements 55A. The enlarged head 32A of the shaft 30A may be flush with the other end portion 15A of the hand grip member 10A, or may be slightly extended out of the other end portion 15A of the hand grip member 10A, or is not extended out of the other end portion 15A of the hand grip member 10A for allowing the shaft 30A of the hand grip member 10A only to be rotated or driven by the driving tool 8A.

Figure 6:
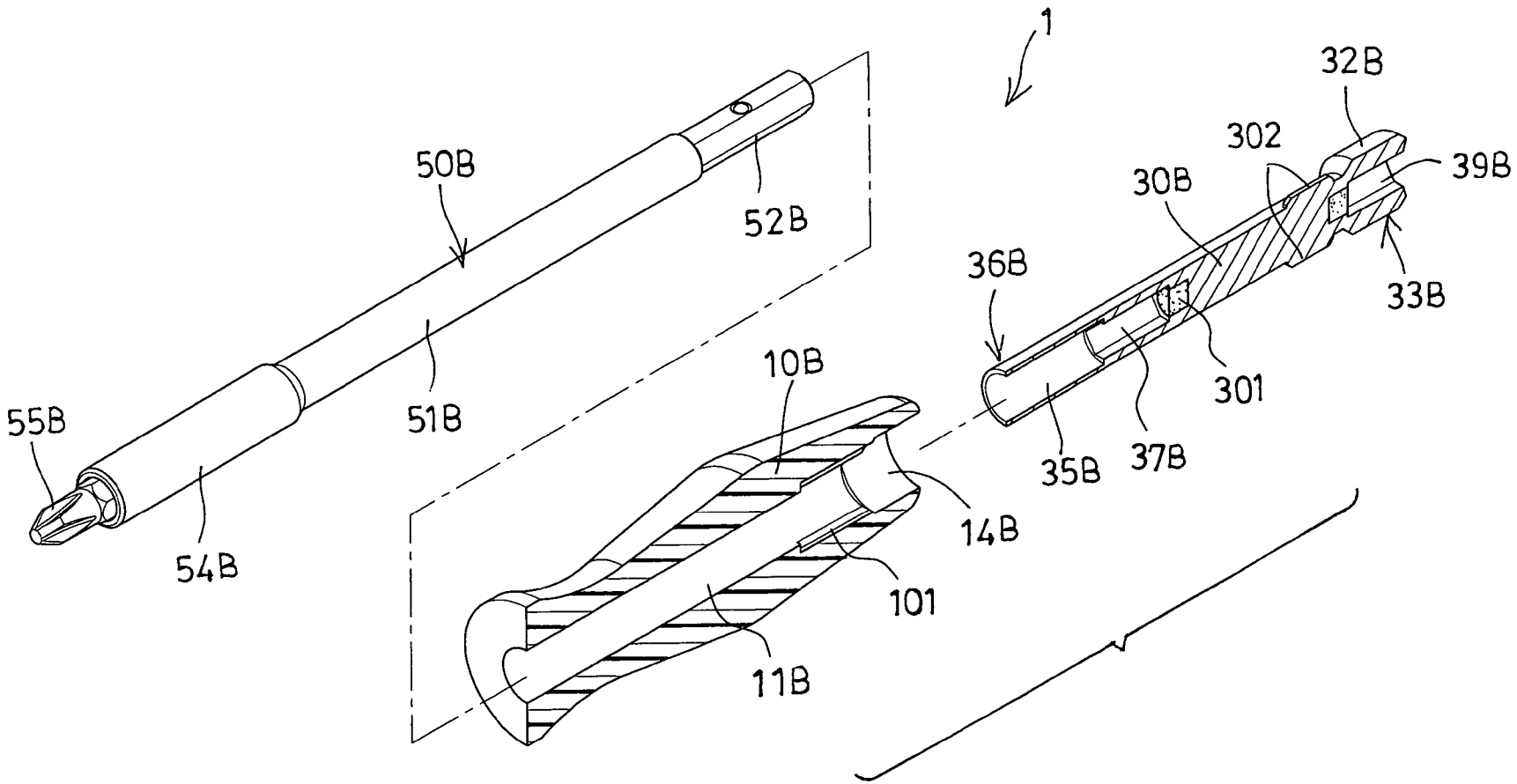
FIG. 6 is an exploded view similar to FIG. 1 illustrating the further arrangement of the tool handle.

Further alternatively, as shown in FIG. 6, the tool handle device 1 may also includes a longitudinal shaft 30B engaged within the longitudinal bore 11B of the hand grip member 10B, and the shaft 30B also includes an enlarged head 32B formed in one end portion 33B of the shaft 30B for engaging into the enlarged compartment 14B of the hand grip member 10B, and also includes an engaging hole 39B formed in the one end portion 33B of the shaft 30B for engaging with and for being driven by a driving tool (not shown). The shaft 30B also includes an orifice 35B formed in the other end portion 36B of the shaft 30B for engaging with or for receiving the tool shank 51B of various tool members 50B, and further includes a noncircular cavity 37B formed therein and communicating with the orifice 35B of the shaft 30B for engaging with the noncircular connector 52B of the tool members 50B and for allowing the tool members 50B to be selectively or changeably rotated or driven by the shaft 30B of the hand grip member 10B.

The shaft 30B further includes one or more magnets or magnetic attracting members 301 engaged therein for engaging with or for acting with the tool members 50B and for attracting or for coupling the tool members 50B to the shaft 30B of the hand grip member 10B. It is also preferable that the tool members 50B each include a socket or tool coupler 54B formed or provided or coupled to the other end thereof for coupling to various fasteners or tool elements 55B and for driving the fasteners or tool elements 55B. The hand grip member 10B may further include one or more (such as two) slots 101 formed therein and communicating with the longitudinal bore 11B of the hand grip member 10B, and the shaft 30B may further include one or more (such as two) ribs or nibs 302 extended therefrom for engaging with the slots 101 of the hand grip member 10B, and for further solidly anchoring or securing the shaft 30B to the hand grip member 10B.

Accordingly, the tool handle in accordance with the present invention may be provided for coupling to various tool members and for driving the tool members and capable of being rotated or driven by the other driving tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool handle device comprising:

a hand grip member including a longitudinal bore formed therein and formed through said hand grip member, and including a first end portion and a second end portion, said hand grip member including an enlarged compartment formed in said second end portion of said hand grip member and communicating with said longitudinal bore of said hand grip member, said compartment of said hand grip member including an inner diameter greater than that of said longitudinal bore of said hand grip member, said hand grip member including an inner peripheral shoulder formed within said longitudinal bore of said hand grip member and located between said longitudinal bore and said compartment of said hand grip member, a shaft engaged in said longitudinal bore of said hand grip member and including a knurled surface formed in an outer peripheral portion thereof for engaging with said hand grip member and for solidly securing to said hand grip member, said shaft including a first end portion having an enlarged head engaged in said compartment of said hand grip member, and including a second end portion engaged in said first end portion of said hand grip member, said shaft including an orifice formed in said second end portion of said shaft, said enlarged head of said shaft including an outer diameter greater than that of said shaft for engaging with of said hand grip member, and said shaft including an outer peripheral shoulder formed between said shaft and said enlarged head for engaging with said inner peripheral shoulder of said hand grip member and for anchoring said shaft to said hand grip member, said shaft including a noncircular segment provided on said first end portion of said shaft and extended out of said second end portion of said hand grip member for engaging with a driving device and for being driven by the driving device, said shaft including a noncircular cavity formed therein and communicating with said orifice of said shaft, said shaft including at least one depression formed therein and laterally formed through said shaft and communicating with said cavity of said shaft, and a tool member including a tool shank detachably engaging into said orifice of said shaft for being rotated and driven by said shaft, said tool member including a noncircular connector for engaging with said cavity of said shaft and for allowing said tool member to be rotated and driven by said shaft of said hand grip member, said tool member including a spring-biased projection engaged therein for engaging with said at least one depression of said shaft and for detachably anchoring said tool member to said shaft, and said shaft including an engaging hole formed in said first end portion of said shaft for engaging with a driving tool and for allowing said shaft of said hand grip member to be selectively rotated and driven by the driving tool.

* * * * *